US005826732A

United States Patent [19]

Ragsdale

[11] Patent Number: 5,826,732

[45] Date of Patent: Oct. 27, 1998

[54] COLLAPSIBLE POINT-OF-PURCHASE DISPLAY APPARATUS

[75] Inventor: Linda Ragsdale, Old Hickory, Tenn.

[73] Assignee: Stone Container Corporation, Chicago, Ill.

[21] Appl. No.: 596,083

[22] Filed: Feb. 6, 1996

[51] Int. Cl.[6] ..... A47F 5/10

[52] U.S. Cl. ..... 211/149; 211/132.1; 211/73; 248/174; 108/165

[58] Field of Search ..... 229/120.14; 211/149, 211/132; 248/174; 206/561

[56] References Cited

U.S. PATENT DOCUMENTS

| | | | |
|---|---|---|---|
| 3,918,576 | 11/1975 | Taub | 211/149 X |
| 4,311,100 | 1/1982 | Gardner et al. | 211/149 X |
| 4,488,652 | 12/1984 | Hinton et al. | 211/149 |
| 4,493,424 | 1/1985 | Smith | 211/149 |
| 4,552,271 | 11/1985 | Kranz | 211/149 X |
| 4,570,805 | 2/1986 | Smith | 211/149 |
| 4,723,664 | 2/1988 | Smith | 211/149 |
| 4,911,311 | 3/1990 | Nagai | 211/132 X |
| 5,213,220 | 5/1993 | McBride | 211/149 X |
| 5,315,936 | 5/1994 | Smith | 211/149 X |
| 5,322,172 | 6/1994 | Maglione | 211/149 X |

*Primary Examiner*—Leslie A. Braun
*Assistant Examiner*—Kimberly T. Wood
*Attorney, Agent, or Firm*—Dick and Harris

[57] ABSTRACT

A collapsible point-of-purchase display apparatus articulable from a single unitary blank of foldable material, and upon articulation, positionable and free standing on a support surface, without formal assembly at the point of purchase location. The apparatus includes a frame and at least one shelf for the display of goods thereon. Furthermore, the apparatus is capable of being reversibly further articulated from its substantially upright, rigid three dimensional display configuration to a substantially flat, planar collapsed configuration for efficient shipment. The apparatus may further include a header board attached to the back panel of the apparatus to further promote and advertise the goods displayed.

19 Claims, 5 Drawing Sheets

180
184
186
185

182
94
183
152
50
96
51
97
92

300
144
156
30
152
210
50

COLLAPSIBLE POINT-OF-PURCHASE DISPLAY APPARATUS

BACKGROUND OF THE INVENTION

The present invention relates in general to a collapsible point-of-purchase display apparatus for goods and, more particularly, to a point-of-purchase display apparatus which is articulable from a single blank of material allowing it to be shipped in a substantially flat manner, while being capable of automatic deployment at the point of purchase location without significant assembly efforts.

The practice of displaying goods for sale within a rigid and highly decorative container is enjoying widespread popularity, especially at outlet stores and discount supermarkets as well as at various rental and sales locations for videotapes and books. This practice allows vendors of the goods to set up stands or displays in areas of unused counter or floor space—thus allowing the vendor to display the goods without having to sacrifice a portion of fixed shelving to the particular goods. Oftentimes, bulky displays fabricated from several sections of flexible material are used. Such bulky and multi-sectioned displays are undesirable, however, because human errors in fabricating the display from its component parts oftentimes results in a poorly assembled display which can directly affect the usefulness of the display in advertising and promoting the goods. Likewise sales personnel in the point-of-purchase locations do not have the time or desire to initiate construction of these displays through detailed "assembly instructions."

In order to overcome such problems, point-of-purchase displays were developed which are fabricated and shipped intact to the retailer, often with the goods being displayed already positioned thereon. Such displays do not require assembly at point-of-purchase locations and therefore ensure that a quality display is maintained. However, such displays are also often undesirable because of the shipping costs and logistics that result from shipping a loaded or unloaded three dimensional object which incorporates a significant amount of open space. Additionally, point-of-purchase displays which are shipped intact still require a third-party to fabricate the displays prior to shipping. Such third party involvement increases the costs associated with the display fabrication and may result in the waste of expensive raw materials.

Accordingly, it is an object of the present invention to provide for an inexpensive point-of-purchase display apparatus that is automatically articulable, with little effort, from a single unitary blank of corrugated material, via "pop-out" deployment for the sturdy display of goods thereon, which display is collapsible to a substantially flat, planar configuration for efficient and inexpensive shipment.

These and other objects of the present invention will become apparent in light of the present specification, claims and drawing.

SUMMARY OF THE INVENTION

The present invention comprises a point-of-purchase display apparatus for displaying goods positionable thereon. The display apparatus has a longitudinal axis and is articulable from a substantially flat, collapsed configuration of foldable material to a substantially rigid, upright three dimensional display configuration. The articulation of the display apparatus is effectuated with minimal fabrication effort but still allows for facilitated, efficient shipment of said display apparatus in a minimum profile orientation while in said collapsed configuration. The apparatus comprises at least one collapsible shelf having a shelf fold substantially perpendicular to a line parallel to said longitudinal axis. The shelf fold allows the shelf to be capable of being deployed from a folded orientation when in its collapsed configuration to its substantially unfolded horizontal deployed position while in its display configuration.

The display apparatus also includes frame means for supporting the respective portions of said at least one shelf. The frame means includes at least one back panel, a first side panel, and a second side panel with the longitudinal axis extending along the height of the frame means. The back and the first and second side panels each have an interior surface, an exterior surface, a top edge, a bottom edge, and two side edges. Each of the first and second side panels are operably attached to emanate from the opposite side edges of the back panel at respective back panel folds. At least one of the back and the first and second side panels have at least one frame panel fold therein which is substantially parallel to the longitudinal axis. The frame panel fold co-operates with the shelf fold in each of the shelves to enable the point of purchase display apparatus to be deployable from said substantially flat, collapsible configuration to said substantially rigid, upright display configuration.

The collapsible shelf is operably attached to at least one of the back panel and the first and second side panels and at least one of said shelves being automatically deployed into its substantially unfolded horizontal position, as a function of the deploying of at least one of the back and the first and second panels—to obviate the need for independently repositioning the shelves at a point of purchase location. The display apparatus is constructed so that at least one of the back and the first and second side panels includes rigidity means which reinforce the point of purchase display apparatus while in said display configuration. The rigidity means preclude the apparatus from undesirably recollapsing into its collapsed configuration along the shelf fold of at least one shelf and said frame panel fold of said at least one back panel, and said first and second side panels.

In a preferred embodiment, the frame means may further include at least one front panel with the front panel being operably attached to one of the side edges of each of the first and second side panels and opposite the side edges which are operably attached to the side edges of the back panel. In a further embodiment of the apparatus, the lowermost of the at least one front panel, in combination with the lowermost of the at least one back panel and the first and second side panels, defines a base region. The base region may also further include at least one base flap which is operably attached to the lower edge of at least one of the back panel and the first and second side panels and the base flap being perpendicularly foldable relative to the base region of the first and second side panels, to enhance the stability of the point of purchase display apparatus upon deployment.

Likewise, in another preferred embodiment, the apparatus includes at least one shelf which is operably attached to the at least one front panel and the at least one back panel. Upon deployment, the at least one shelf is substantially horizontal, and substantially perpendicular to at least one back panel and the first and second side panels. The front panel may be operably attached to the at least one shelf along a front panel shelf fold line with the front panel shelf fold line further including at least one lip which extends from at least a portion of the front panel shelf fold line upwardly, along the front panel shelf fold line. The at least one lip precludes inadvertent forward slippage of the goods which are displayed on the at least one shelf.

In one preferred embodiment the apparatus further includes locking means for securing the at least one shelf into a deployed position. The locking means may further include a locking tab which is attached to a rear shelf edge of the at least one shelf, with at least a portion of the locking tab further cooperating with and being substantially adhered to the interior surface of the back panel. Likewise, the locking means may further include a locking tab which is attached to the at least one shelf and extends through at least one corresponding locking slot in the back panel in an interlocking engagement. In another embodiment, the locking tab may extend through the locking slot and be adhered to the exterior surface of the back panel.

In another preferred embodiment, the rigidity means are further comprised of at least one upper back flap which is attached to the top edge of the at least one back panel, and at least one side rigidity flap is also associated with at least one of the first and second side panels proximate said upper back flap. The back flap and the at least one side rigidity flap may be positionable in an overlying orientation with a portion of the interior surface of the back panel and the at least one of the side panels, respectively, and the upper back flap and the side rigidity flap being releasably interlockable relative to each other.

In a preferred embodiment having at least two shelves, the apparatus further includes at least one decorative flap which is associated with at least one of the at least two shelves which is not the uppermost of the at least two shelves. The at least one decorative flap is also attached to at least one of the first and second side panels. The at least one decorative flap is positionable in an overlying orientation which is relative to the interior surface of the first and second side panels in order to preclude visualization of the unfinished flap edges.

In another preferred embodiment, the display apparatus further includes means for attaching a header board. The means for attaching the header board may comprise at least one slot which is associated with at least a portion of the top edge of the back flap in order to engage a protrusion on the header board.

In the preferred embodiment, the frame panel fold further comprises a gusseted fold which is in a predetermined position on each of the first and second side panels. The gusseted fold extends the height of the first and second side panels and the gusset fold divides the first and second side panels into a first side and a second side portion, both of which are joined at the gusseted fold. The frame panel fold facilitates the conversion of the point-of-purchase display apparatus from the substantially rigid, upright three dimensional display configuration to the substantially flat, collapsed configuration by folding the first and second side panels along the gusset fold and folding the at least one shelf along the shelf fold such that the first side portion of each of the first and second panels and the at least one shelf being in overlying engagement with the second side portion of the first and second side panels and the at least one shelf.

In one such preferred embodiment the display apparatus comprises one back panel and three front panels, wherein said front panels are operably attached to one of the side edges of each of the first and second side panels, opposite the portion of where the side edges operably attach to the back panel. The display apparatus also includes three shelves and rigidity means. Preferably, the rigidity means further comprises at least one upper back flap attached to the top edge of the back panel or at least one side rigidity flap associated with at least one of the first and second side panels, proximate the upper back flap. In these embodiments the back flap and the at least one side rigidity flap are positionable in an overlying orientation with a portion of the interior surface of the back or side panels. Moreover the upper back flap and/or the side rigidity flaps are releasably interlockable, relative to the remainder of the apparatus. Preferably, both a back panel and one or more side panels interlock with each other to reinforce the apparatus and preclude a "memory" collapse along the gusset and shelf folds. The display apparatus further includes locking means for securing the at least one shelf into a deployed position. The locking means further comprising a locking tab attached to the shelves, with the locking tab extending through at least one corresponding locking slot in the back panel in an interlocking engagement, with the at least one locking tab operably attached, preferably through adherence, to the exterior surface of the back panel. The apparatus also includes two decorative flaps associated with each of the shelves which are not the uppermost of a plurality of shelves, with one of the decorative flaps attached to each of the first and second side panels, to preclude visualization of the decorative flap edge—which would otherwise expose corrugated flutes.

It is contemplated that the apparatus is constructed from a single blank of material. In a preferred embodiment the single blank of material is contemplated to be a single unitary blank of corrugated paperboard material. In yet another preferred embodiment, the single unitary blank of corrugated paperboard material is covered with a decorative layer of material operatively affixed to at least the exposed portion of the point-of-purchase display apparatus.

DETAILED DESCRIPTION OF THE DRAWINGS

Figure 1:
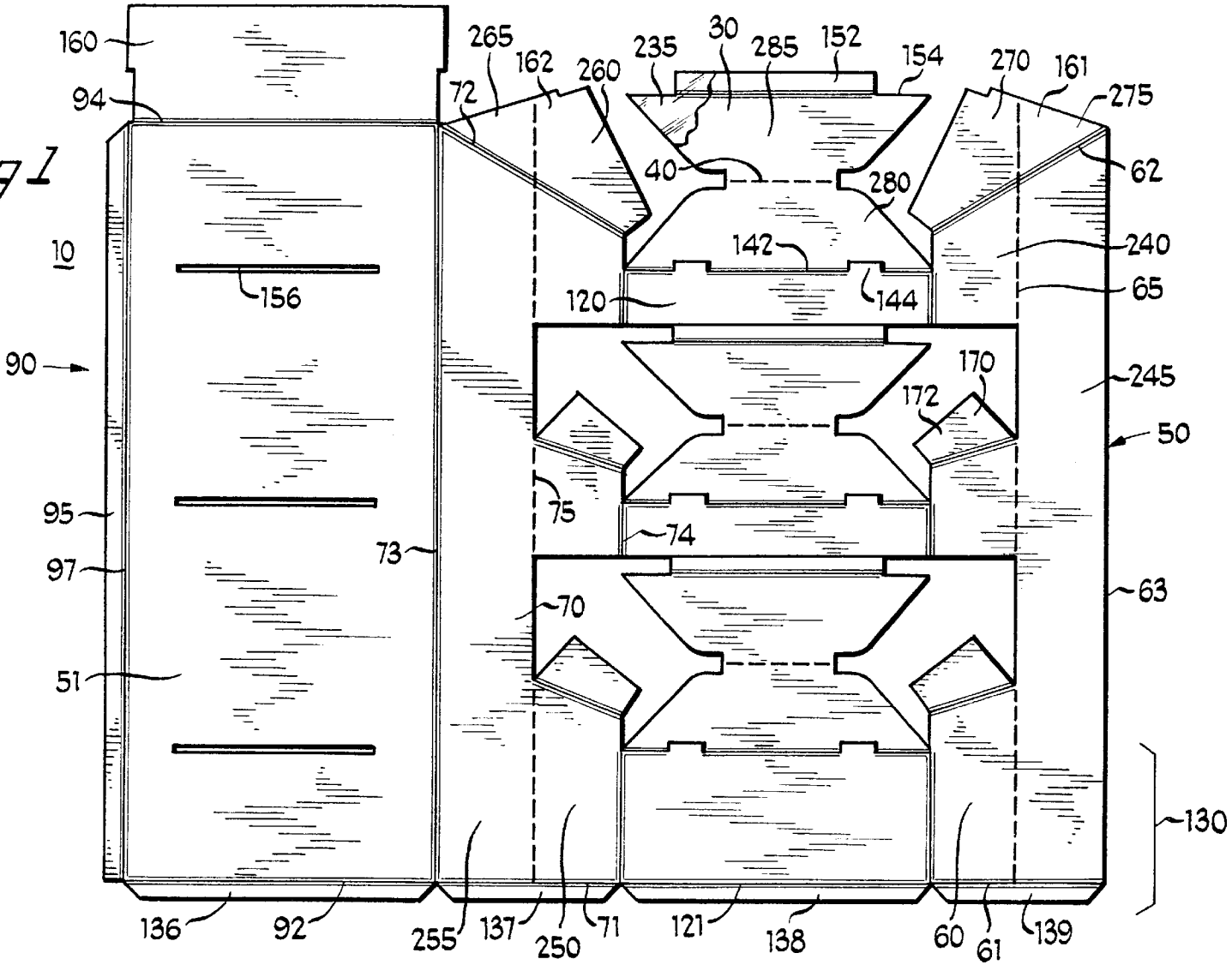
FIG. 1 of the drawings is a plan view of the unarticulated blank of a point-of-purchase display apparatus embodying the present invention showing the back, front, and side panels in their unattached, unarticulated orientation.

While this invention is susceptible of embodiment in many different forms, there are shown in the drawings and will herein be described in detail, two specific embodiments, with the understanding that the present disclosure is to be considered as an exemplification of the principles of the invention and is not intended to limit the invention to the embodiments illustrated.

One preferred embodiment of the present point-of-purchase display apparatus 10 for the displaying of goods (not shown) positionable thereon, is shown in FIGS. 1, 2, and 4 through 8, as comprising frame means 50, collapsible shelves, such as collapsible shelf 30, front panels, such as front panel 120, base region 130, locking means (described hereinbelow), means for attaching a header board (described hereinbelow), and decorative flaps such as decorative flap 170. It is preferable that the entire point-of-purchase display apparatus is constructed from a single unitary blank of material, such as a single unitary blank of corrugated paperboard material, though the invention further contemplates fabrication of the point-of-purchase display from a plastic sheet material. Additionally, the display apparatus may include decorative layer 235 attached to at least a portion of the display apparatus to enhance the appearance of same.

As can be seen FIG. 1, point-of-purchase display apparatus has an exterior surface 90 and an interior surface 80 (FIG. 2) opposite exterior surface 90. Collapsible shelves, such as shelf 30, include shelf fold 40, rear shelf edge 154 and front panel shelf fold line 142. Shelf 30 is attached to front panel 120 along the front panel shelf fold line 142. Front panels, such as front panel 120, include lips, such as lip 144, which extend upwardly along a portion of front panel shelf fold line 142. The lips preclude inadvertent forward slippage of goods displayed on the shelves, such as shelf 30. Alternatively, lip 144 may releasably engage a panel holding the goods being displayed thereon to prevent forward inadvertent slippage. It is also contemplated that the goods be shipped to the point-of-purchase location separate from the point-of-purchase display apparatus 10. In such an embodiment, the goods will be shipped on a panel which may be releasably placed onto shelf 30 so as to display the goods.

Figure 4:
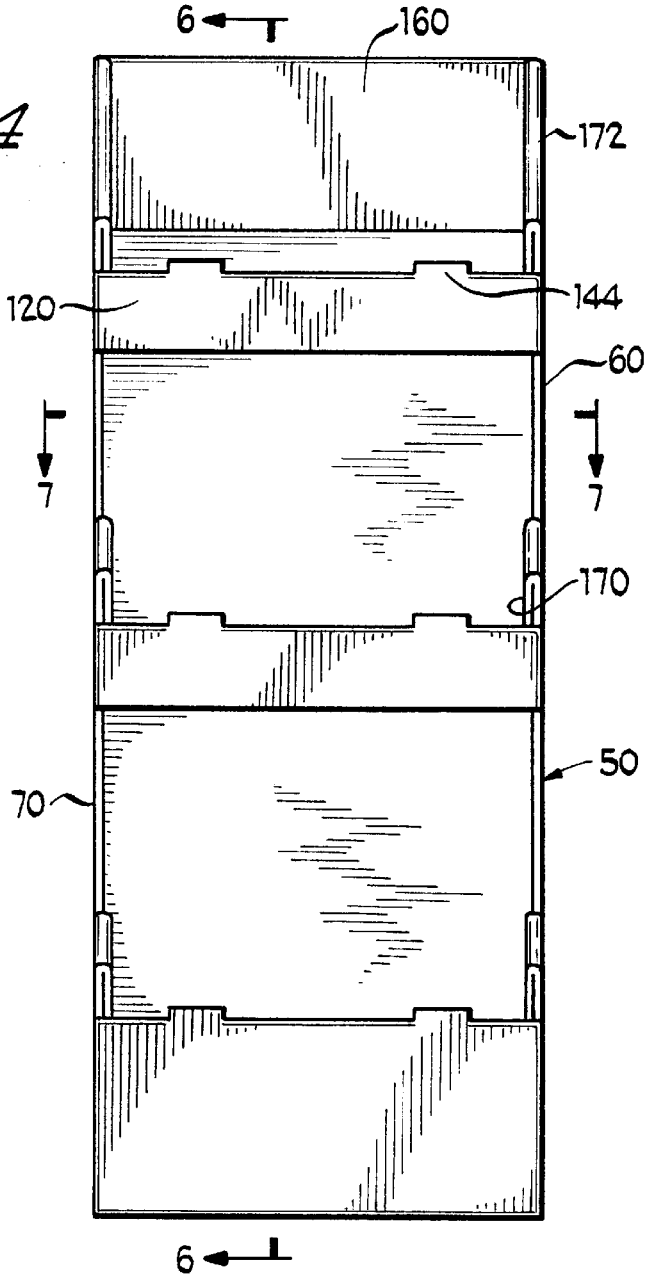
FIG. 4 of the drawings is an elevational front view of the point-of-purchase display apparatus of FIG. 2, showing, in particular, the display apparatus containing three shelves.
Figures 5, 6:
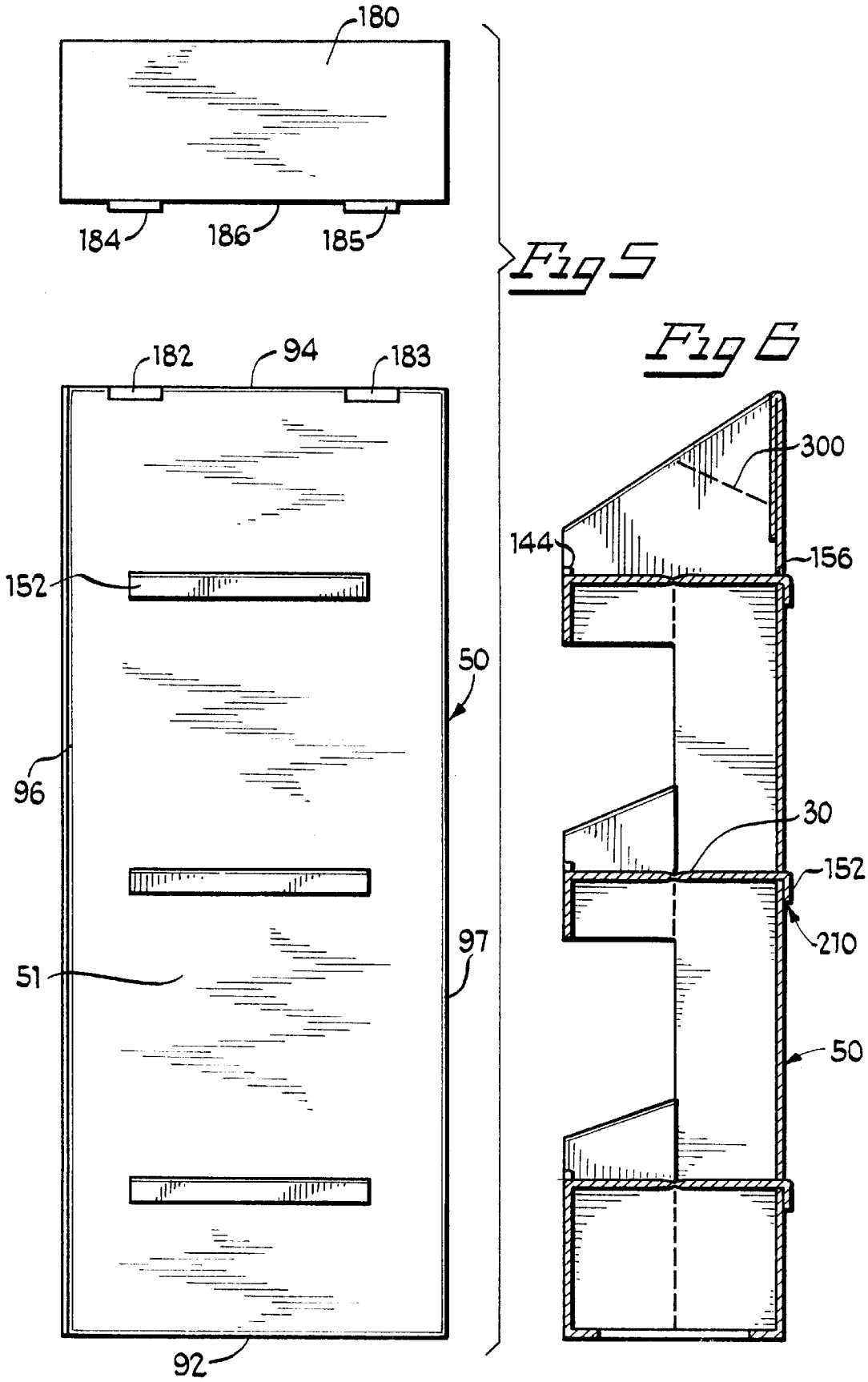
FIG. 5 of the drawings is an exploded elevational rear view of the apparatus, showing in particular the display apparatus with locking tabs on its shelves penetrating aligned locking slots on the rear panel, together with an insertable header board for attachment at the top of the display.
FIG. 6 of the drawings is a cross-sectional view of the articulated point-of-purchase display apparatus of FIG. 2, taken generally along lines 6—6 of FIG. 4 and looking in the direction of the arrows showing the orientation of the apparatus shelf folds and side panel gusset folds that collectively enable off-site fabrication and on site automatic "pop-out" articulation of the device.

Frame means 50, as shown in FIGS. 1, 2 and 4 through 8, includes back panel 51, first side panel 60, second side panel 70, and rigidity means. Back panel 51, as shown in FIG. 5, includes top edge 94, bottom edge 92, articulation flap 95, and side edges 96, 97. First side panel 60 (FIG. 1), includes top edge 62, bottom edge 61, first side edge 63, second side edge 64, and gusseted fold 65. Second side panel 70 (FIG. 1), includes top edge 72, bottom edge 71, first side edge 74, second side edge 73, and gusseted fold 75. First side panel 60 (FIG. 2) is attached to front panels, such as front panel 120, along first panel second side edge 64 and second side panel 70 is attached to the front panels along second panel first side edge 74. Back panel 51 is attached to second side panel along second side panel second side edge 73. In this configuration, first side panel 60, second side panel 70, front panels 120, and back panel 51 are all attached along their respective side edges. Furthermore, it is contemplated that all side edges be folds hingedly placed within a single unitary blank of flexible material.

Rigidity means, as shown in FIG. 1, includes upper back flap 160 and side rigidity flaps, such as side rigidity flaps 161 and 162. Upper back flap 160 is attached to back panel 51 along back panel top edge 94, and side rigidity flaps 161 and 162 are attached to first and second side panels along first and second side panel edge 62 and 72, respectively. Alternatively, it is further contemplated that rigidity means includes a tensioning device, such as a U-clip or any other type of retaining member which will bias the back panel or the first and second side panels in such a manner as to preclude undesirable and inadvertent spontaneous folding of the display apparatus 10.

Figure 2:
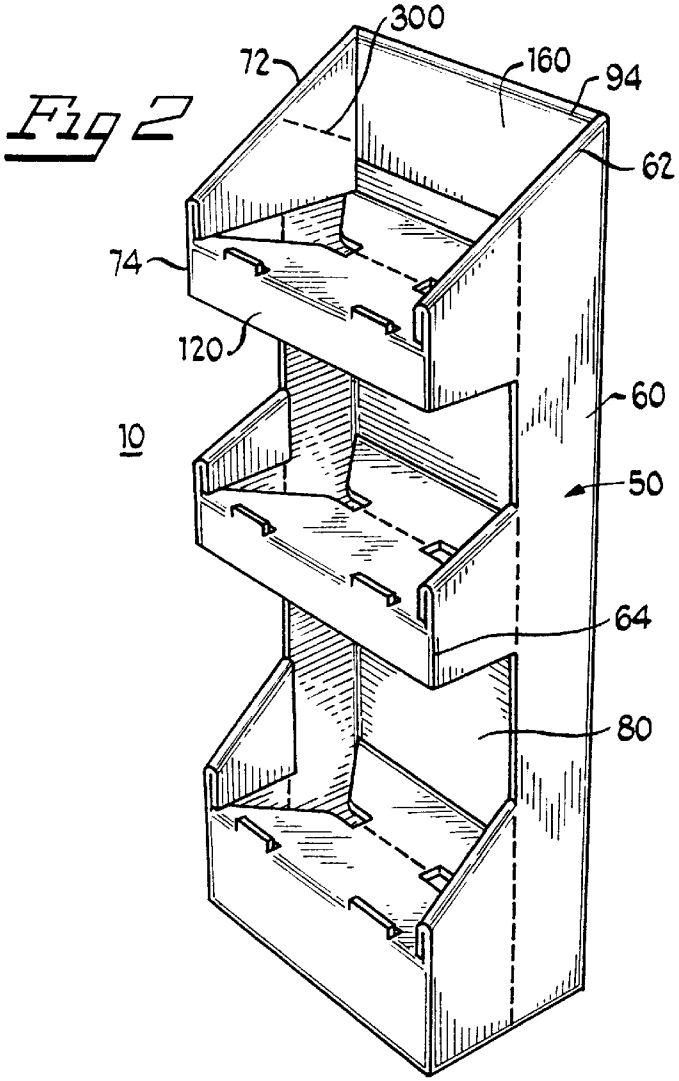
FIG. 2 of the drawings is a side-top perspective view of the apparatus, showing in particular the display apparatus containing three shelves, in its preliminarily attached, fully deployed and articulated orientation.

Base region 130, as shown in FIG. 2, includes lowermost front panel 120, lowermost back panel 51 (FIG. 1), lowermost first and second side panels 60, 70 (FIG. 1), back panel bottom edge 92 (FIG. 1), and base flaps, such as base flaps 136, 137, 138, and 139. Base flaps 136, 137, 138, and 139 are attached to back panel 51, second side panel 70, front panel 120, and first side panel 60, along back panel bottom edge 92, second side panel bottom edge 71, front panel bottom edge 121, and first side panel bottom edge 61, respectively. The base flaps are perpendicularly foldable along the respective bottom edges of each of the back, second side, front, and first side panels relative to the longitudinal axis. The base flaps enhance the stability of the point of purchase display when displaying goods.

Locking means as shown in FIG. 1, includes locking tabs, such as locking tab 152, which are attached to rear shelf edges, such as rear shelf edge 154, and locking slots, such as locking slot 156, which are operably positioned within back panel 51. Decorative flaps, such as decorative flap 170, are attached to first and second side panels along the decorative flap edges, such as decorative flap edge 172.

As shown in FIG. 5, back panel 51 further includes means for attaching a header board 180. Header board attachment means includes attachment slots 182 and 183 which are cut into a portion of back panel top edge 94. Header board 180 further includes protrusions 184 and 185 which emanate downwardly from header board bottom edge 186. The protrusions engage back panel attachment slots 182 and 183 and facilitate the rigid attachment of header board 180 to point-of-purchase display apparatus 10 for further advertising and promoting the goods displayable thereon. Alternatively, means for attaching the header board 180 may also comprise a single protrusion or any other fastening device, such as an adhesive, which will attach header board 180 to back panel 51.

It is also contemplated that the entire point-of-purchase display apparatus 10 may be covered with a decorative layer of material. Such a covering would enhance the aesthetic visualization of the apparatus and/or the marketing of the goods displayed on the apparatus but would not effect the proper deployment and operation of the apparatus.

As shown in FIG. 1, the point-of-purchase display apparatus 10, in its unarticulated form, is shown with exterior surface 90 facing the viewer. Point of purchase display 10 is articulated into its substantially rigid, upright display configuration as follows. First side panel 60 is folded along first side panel second side edge 64 perpendicular to front panel 120 and away from the observer, as FIG. 1 is viewed. Second side panel 70 is next folded along second side panel first side edge 74 perpendicular to front panel 120 and away from the observer, as FIG. 1 is viewed. Back panel 51, which is attached to second side panel 70 along second side panel second side edge 73, is substantially parallel to the folded first side panel 60. Back panel 51 is folded along second panel second side edge 73 parallel to front panel 120. Articulation flap 95 is then folded along back panel side edge 97 perpendicular to back panel 51 and toward the observer, as FIG. 1 is viewed. Articulation flap 95 is then juxtaposed against the interior surface 80 of first panel 60 along said first side panel first side edge 63. Once articulation flap 95 is juxtaposed against the interior surface 80 of first panel 60, paperboard to paperboard bond 200 is effectuated, more preferably paperboard to paperboard bond 200 is effectuated through the use of an adhesive. Of course, it is also contemplated that articulation flap 95 comprise a plurality of articulation tabs which may be adhered to the interior surface 80 of first panel 60 or releasably engage articulation slots which emanate through interior surface 80 to exterior surface 90 of side panel 60. Furthermore, back panel 51 may be attached, and it is contemplated as so being attached in another embodiment, by adhering back panel side edge 97 to first side panel 60 first side edge 63.

Collapsible shelf 30 is then articulated by folding collapsible shelf 30 along front panel shelf fold line 142 away from the observer, as FIG. 1 is viewed, and into an orientation that is substantially perpendicular to front panel shelf fold line 142 and longitudinal axis 20, as shown in FIG. 6. Folding collapsible shelf 30 along the front panel shelf fold line 142, exposes lips, such as lip 144, which emanate upwardly from the front panel shelf fold line 142 and parallel to the front panel shelf fold line 142. Locking tab 152 is next inserted through locking slot 156 and then folded perpendicularly along rear shelf edge 154 so as to juxtapose the interior surface 80 of locking tab 152 against the exterior surface 90 of back panel 51, as shown in FIG. 6. Once the interior surface 80 of locking tab 152 is juxtaposed against the exterior surface 90 of back panel 51, paperboard to paperboard bond 210 is effectuated, more preferably paperboard to paperboard bond 210 is effectuated through the use of an adhesive.

Figure 7:
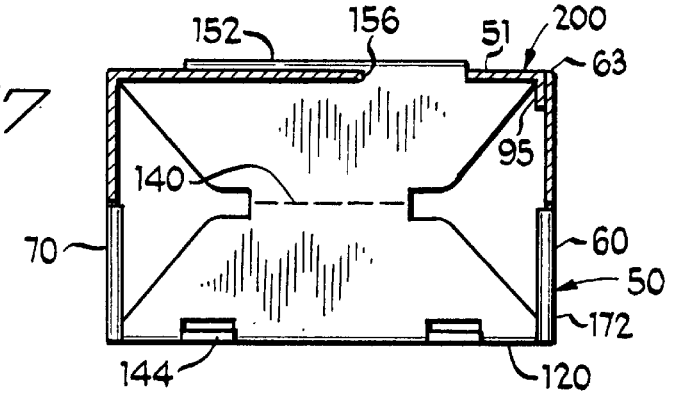
FIG. 7 of the drawings is a cross-sectional view of the articulated point-of-purchase display apparatus of FIG.2, taken generally along lines 7—7 of FIG. 4 and looking in the direction of the arrows, showing one such shelf fold and the cooperating gusseted side folds, together with decorative side panel flaps that cover the otherwise visible corrugated flutes.

The articulated point-of-purchase display, as shown in FIG. 7, includes first side panel 60 being substantially parallel to second side panel 70. Back panel 51 is substantially parallel to front panel 120 with back panel 51 and front panel 120 being substantially perpendicular to first side panel 60 and second side panel 70. Collapsible shelf 30 is substantially horizontally suspended between back panel 51 and front panel 120 along front panel shelf fold line 142 and rear shelf edge 154. Lip 144 emanates upwardly along the front panel shelf fold line 142 towards the observer, as FIG. 7 is viewed. As can also be seen from FIG. 7, the paperboard to paperboard bonds 200 and 210 are between the exterior surface 90 of articulation flap 95 and interior surface 80 of first side panel 60 and interior surface 80 of locking tab 152 with exterior surface 90 of back panel 51, respectively.

Figure 8:
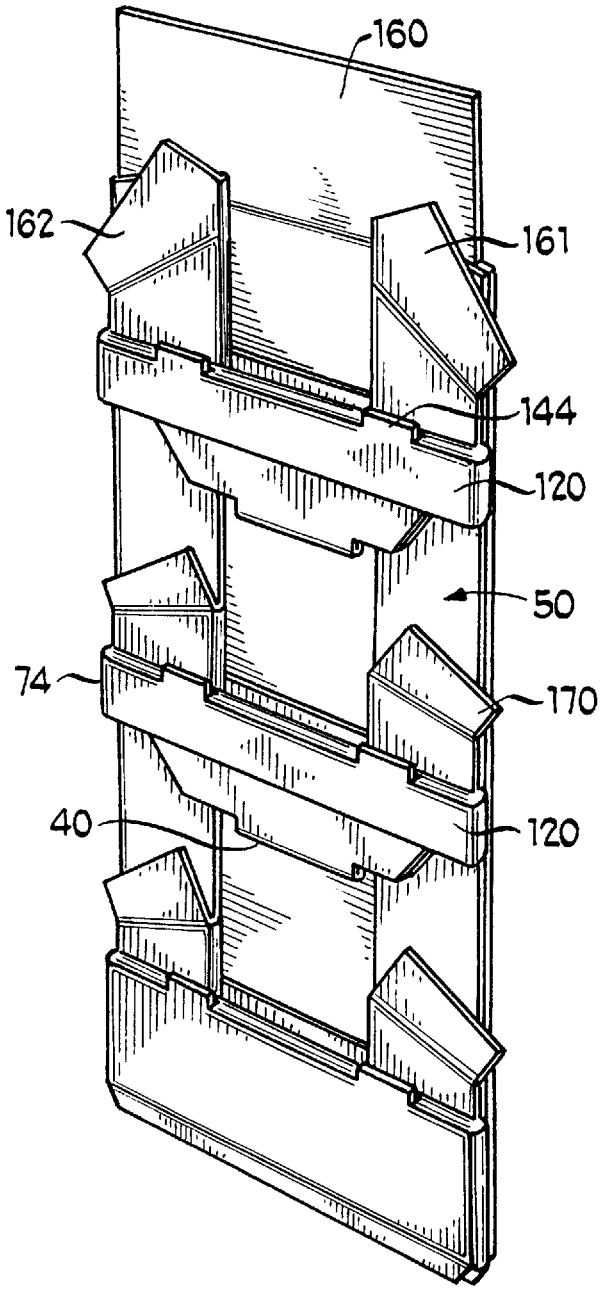
FIG. 8 of the drawings is a side perspective view of the articulated point-of-purchase display apparatus of FIG. 2 in its substantially flat collapsed configuration showing the display apparatus after preliminary fabrication in its collapsed orientation, but before articulation to its deployed orientation for the display of supported products at the point of purchase location.

It is contemplated that the articulated point-of-purchase display be further articulable into a substantially flat, collapsed configuration for facilitated, efficient shipment of the display apparatus in a minimum profile orientation. Point-of-purchase display 10 is articulated into its collapsed configuration, as shown in FIG. 8, by contemporaneously folding first side panel gusseted fold 65, second side panel gusseted fold 75, and shelf fold 40. Collapsible shelf 30 is folded upwardly along shelf fold 40 so that the exterior surface 90 of forward shelf region 280 is juxtapose against the exterior surface 90 of rear shelf region 285. Folding collapsible shelf 30 along shelf fold 40 in such a manner brings front panel 120 into a close spatial relationship with back panel 51. At the same time that collapsible shelf 30 is being folded, first and second side panels 60, 70 are folded along first and second side panel gusseted folds 65, 75 respectively. First side panel 60 is folded along first side panel gusseted fold 65 such that the exterior surface of first side panel forward region 240 is juxtaposed against the exterior surface 90 of first side panel rear region 245 and as second side panel 70 is folded along second side panel gusseted fold 75, the exterior surface 90 of second side panel forward region 250 is juxtaposed against the exterior surface 90 of second side panel rear region 255. In a preferred embodiment, all folding is done contemporaneously so that as shelf fold 40 is folded and collapsible shelf rear region 285 is juxtaposed against collapsible shelf forward region 280, the folding of the first and second side panels 60, 70 is facilitated.

As shown in FIG. 8, after articulation into the collapsed configuration, the point-of-purchase display has a minimum profile. In the collapsed version, side rigidity flaps 161, 162 are also folded along first and second side panel gusseted fold lines 65, 75 so that the exterior surfaces 90 of the forward and rear regions 270, 275 of side rigidity flap 161 are juxtaposed against one another. Likewise, in the collapsed configuration the exterior surfaces 90 of the forward and rear regions 260, 265 of side rigidity flap 162 are juxtaposed against one another. Furthermore, upper back flap 160 emanates substantially parallel to the back panel along the back panel top edge 94. In the collapsed configuration, the point-of-purchase display can be efficiently shipped in a minimum profile.

Deployment of the point-of-purchase display into its substantially, rigid, reinforced, upright three dimensional display configuration, as shown in FIG. 2 is accomplished by taking the point-of-purchase display in its collapsed configuration and applying an external force to the front panel 120, the force being applied so as to pull front panel 120 towards the observer, as FIG. 8 is viewed. An additional force may also be applied to each of the first and second side panels 60, 70 in a way so as to pull the first and second side panels 60, 70 in a direction parallel to one another and perpendicular to the longitudinal axis 20. It is also contemplated that no such external force need be applied, and that the inherent internal tension created within the display by gusset folds 40, 65, and 75 in the collapsed configuration, will be sufficient force to deploy the display from its collapsed configuration to its upright configuration.

Collapsible shelf 30 is deployed into its substantially horizontal position suspended between back panel 51 and front panel 120 along rear shelf edge 154 and front panel shelf fold line 142, by relative movement of front panel 120 away from back panel 51. Base flaps 136, 137, 138, and 139 may be folded perpendicularly to back panel 51, second side panel 70, front panel 120, and first side panel 60 so that the interior surface 80 of said base flaps 136, 137, 138 and 139 is juxtaposed against a substantially flat horizontal surface. In another preferred embodiment, it is contemplated that base flaps 136, 137, 138, and 139 be folded perpendicularly to back panel 51, second side panel 70, front panel 120, and first side panel 60 so that the exterior surface 90 of said base flaps 136, 137, 138 and 139 is juxtaposed against a substantially flat horizontal surface.

In order to further rigidify the point-of-purchase display, side rigidity flaps 161 and 162 are folded along the first side panel top edge 62 and second side panel top edge 72 respectively so as to juxtapose the interior surface 80 of side rigidity flap 161 against the interior surface 80 of first side panel 60 and to juxtapose the interior surface 80 of side rigidity flap 162 against the interior surface 80 of second side panel 70. As shown in FIG. 2, as the side rigidity flaps 161, 162 are folded, the first and second side panel gusseted fold lines 65, 75, which extend the height of the first and second side panels 60, 70 and through side rigidity flaps 161, 162, are positioned at a downwardly acute angle 300 towards back panel 51. The downwardly acute angle 300 reinforces the point-of-purchase display and protects the display from inadvertent spontaneous articulation into the collapsed configuration. After the side rigidity flaps are in place, back rigidity means such as upper back flap 160 is folded along back panel top edge 94 so that the interior surface 80 of the upper back flap 160 is juxtaposed against the interior surface of back panel 51. The upper back flap 160, while in its juxtaposed position, is in an overlying orientation with a portion of the side rigidity flaps 161, 162 and the upper back flap 160 is further releasably interlockable relative to the side rigidity flaps 161, 162.

Finally, as shown in FIG. 4, decorative flap 170 is folded along decorative flap edge 172 so that the interior surface 80 of decorative flap 170 is juxtaposed against the interior surface 80 of first and second side panels 60, 70. In its juxtaposed position, decorative flap 170 provides a uniformly smooth and uninterrupted shape along decorative flap edge 172 and precludes visualization of the unfinished flute ends of the corrugated paperboard material.

Figure 3:
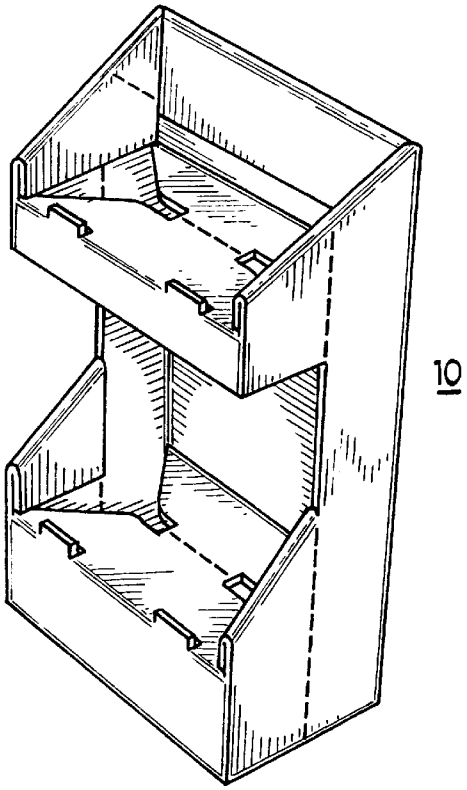
FIG. 3 of the drawings is a side-top perspective view of another embodiment of the apparatus, showing in particular a display apparatus containing two shelves, in its preliminarily attached, fully deployed and articulated orientation.

In another preferred embodiment, and as shown in FIG. 3, the point-of-purchase display apparatus 10 is articulated from a single blank of material and has but two shelves 30. Such an embodiment of the display may be desirable for counter top displays and/or displays in which a minimum of vertical space is available. It is further contemplated that point-of-purchase display apparatus 10 have at least one shelf 30, with the maximum number of shelves being determined by the amount of vertical space and/or display height requirements of the point-of-purchase display location.

The foregoing description and drawings are merely to explain and illustrate the invention and the invention is not limited thereto except insofar as the appended claims are so limited, as those skilled in the art who have the disclosure before them will be able to make modifications and variations therein without departing from the scope of the invention.

What is claimed is:

1. A point-of-purchase display apparatus for displaying goods positionable thereon, said display apparatus having a longitudinal axis and being articulable from a substantially flat, collapsed configuration of foldable material to a substantially rigid, upright three dimensional display configuration with minimal fabrication effort, while enabling facilitated, efficient shipment of said display apparatus in a minimum profile orientation while in said collapsed configuration, said display apparatus comprising:

at least one collapsible shelf having a shelf fold substantially perpendicular to a line parallel to said longitudinal axis so as to be capable of being deployed from a folded orientation in said collapsed configuration to a substantially unfolded horizontal deployed position in said display configuration, frame means for supporting the respective portions of said at least one shelf, said frame means including at least one back panel, a first side panel, and a second side panel, said longitudinal axis extending along the height thereof, each of said back and said first and second side panels having an interior surface, an exterior surface, a top edge, a bottom edge, and two side edges with each of said first and second side panels operably attached to and emanating from the opposite side edges of said back panel, at respective back panel folds thereat, at least one of said at least one back and said first and second side panels having at least one frame panel fold therein substantially parallel to said longitudinal axis, said at least one frame panel fold co-operating with said shelf fold in each of said at least one shelf to enable said point of purchase display apparatus to be deployable from said substantially flat, collapsible configuration to said substantially rigid, upright display configuration, said at least one collapsible shelf being operably attached to at least one of said at least one back panel and said first and second side panels with at least one of said at least one shelf being automatically deployed into its substantially unfolded horizontal position, as a function of the deploying of said at least one back and said first and second panels to obviate the need for independently repositioning said at least one shelf at a point of purchase location, at least one of said at least one back and said first and second side panels including rigidity means for reinforcing the point of purchase display apparatus in said display configuration, to preclude said apparatus from undesirably recollapsing to its collapsed configuration along said shelf fold of said at least one shelf and said frame panel fold of said at least one back panel, and said first and second side panels;

at least one front panel, said front panel operably attached to one of said side edges of each of said first and second side panels, opposite said side edges operably attached to said side edges of said back panel, the lowermost of said at least one front panel, in combination with the lowermost of said at least one back panel and first and second side panels, defines a base region;

said base region further including at least one base flap operably attached to said lower edge of at least one of said back panel and said first and second side panels, said at least one base flap perpendicularly foldable relative to said base region of said first and second side panels to enhance the stability of said point of purchase display apparatus upon deployment.

2. The apparatus according to claim 1, wherein said at least one shelf is operably attached to said at least one front panel and said at least one back panel, upon deployment said at least one shelf being substantially horizontal, and substantially perpendicular to said at least one back panel and said first and second side panels.

3. The apparatus according to claim 1, wherein said front panel is operably attached to said at least one shelf along a front panel shelf fold line;

said front panel shelf fold line further including at least one lip extending from at least a portion of said front panel shelf fold line upwardly, along said front panel shelf fold line, said at least one lip precluding inadvertent forward slippage of said goods displayed on said at least one shelf.

4. The apparatus according to claim 1, further including locking means for securing said at least one shelf into a deployed position.

5. The apparatus according to claim 4, wherein said locking means further includes a locking tab attached to a rear shelf edge of said at least one shelf, at least a portion of said locking tab further cooperating with and being substantially adhered to said interior surface of said back panel.

6. The apparatus according to claim 4, wherein said locking means further includes a locking tab attached to said at least one shelf, said locking tab extending through at least one corresponding locking slot in said at least one back panel in an interlocking engagement.

7. The apparatus according to claim 6, wherein said at least one locking tab is operably adhered to said exterior surface of said back panel.

8. The apparatus according to claim 1, wherein said rigidity means comprises at least one upper back flap attached to said top edge of said at least one back panel, and at least one side rigidity flap associated with at least one of said first and second side panels, proximate said upper back flap, said back flap and said at least one side rigidity flap being positionable in an overlying orientation with a portion of said interior surface of said back panel and said at least one of said side panels, respectively, and said upper back flap and said side rigidity flap being releasably interlockable relative to each other.

9. The apparatus according to claim 1 having at least two shelves, said apparatus further including:

at least one decorative flap associated with at least one of said at least two shelves, which is not the uppermost of said at least two shelves, said at least one decorative flap attached to at least one of said first and second side panels, positionable in overlying orientation relative to said interior surface of said first and second side panels, to preclude visualization of unfinished flap edges.

10. The apparatus according to claim 8, further including means for attaching a header board.

11. The apparatus according to claim 10, wherein said attachment means comprises at least one slot associated with at least a portion of said top edge of said back flap, to engage a protrusion on said header board.

12. The apparatus according to claim 1, wherein said frame panel fold comprises:

a gusseted fold in a predetermined position on each of said first and second side panels, said gusseted fold extending the height of said first and second side panels; and said gusset fold dividing said first and second side panels into a first side and a second side portion, joined at said gusseted fold.

13. The apparatus according to claim 10, wherein said point-of-purchase display apparatus is converted from said substantially rigid, upright three dimensional display configuration to said substantially flat, collapsed configuration by folding said first and second side panels along said gusset fold and folding said at least one shelf along said shelf fold such that said first side portion of each of said first and second panels and said at least one shelf being in overlying engagement with said second side portion of said first and second side panels and said at least one shelf.

14. The apparatus according to claim 1, comprising:

one back panel;

at least two front panels, wherein each of said front panels are operably attached to one of said side edges of each of said first and second side panels, opposite said side edges operably attached to said side edges of said back panel;

at least two shelves;

rigidity means further comprising at least one upper back flap attached to said top edge of said back panel, and at least one side rigidity flap associated with at least one of said first and second side panels, proximate said upper back flap, said back flap and said at least one side rigidity flap being positionable in an overlying orientation with a portion of said interior surface of said back panel and said at least one of said side panels, respectively, and said upper back flap and said side rigidity flap being releasably interlockable relative to each other;

locking means for securing said at least two shelves into a deployed position, wherein said locking means comprises a locking tab attached to said at least two shelves, said locking tab extending through at least one corresponding locking slot in said back panel in an interlocking engagement, said at least one locking tab operably adhered to said exterior surface of said back panel; and and two decorative flaps associated with each of said two of said shelves which are not the uppermost of said at least two shelves, one of said decorative flaps attached to each of said first and second side panels, to preclude visualization of said decorative flap edge.

15. The apparatus according to claim 1, further including means for attaching a header board.

16. The apparatus according to claim 15, wherein said attachment means comprises at least one slot associated with at least a portion of said top edge of said back flap, to engage a protrusion on said header board.

17. The apparatus according to claim 1, further including a decorative layer of material operatively affixed to at least a portion of said apparatus.

18. The apparatus according to claim 1, wherein the apparatus is assembled from a single unitary blank of material.

19. The apparatus according to claim 1, wherein the apparatus is assembled from a single unitary blank of corrugated paperboard material.

* * * * *